US010957464B2

(12) United States Patent
Walder et al.

(10) Patent No.: US 10,957,464 B2
(45) Date of Patent: Mar. 23, 2021

(54) ELECTRICALLY INSULATED ELECTRIC CONDUCTOR STRIP, IN PARTICULAR FOR ELECTRIC MOTORS AND TRANSFORMERS

(71) Applicants: ALANOD GMBH & CO. KG, Ennepetal (DE); ALCOTEC ALUMINIUM COIL TECHNOLOGY GMBH, Ennepetal (DE)

(72) Inventors: Marcus Walder, Wipperfürth (DE); Stefan Ziegler, Sprockhövel (DE); Volker Wandelt, Cologne (DE)

(73) Assignee: ALANOD GmbH & Co. KG, Ennepetal (DE)

( * ) Notice: Subject to any disclaimer, the term of this patent is extended or adjusted under 35 U.S.C. 154(b) by 0 days.

(21) Appl. No.: 16/500,917

(22) PCT Filed: Mar. 19, 2018

(86) PCT No.: PCT/EP2018/056831
§ 371 (c)(1),
(2) Date: Oct. 4, 2019

(87) PCT Pub. No.: WO2018/184823
PCT Pub. Date: Oct. 11, 2018

(65) Prior Publication Data

US 2020/0118707 A1 Apr. 16, 2020

(30) Foreign Application Priority Data

Apr. 5, 2017 (DE) ..... 10 2017 107 328.0

(51) Int. Cl.
*H01B 7/18* (2006.01)
*H01B 7/00* (2006.01)
*H01F 27/28* (2006.01)

(52) U.S. Cl.
CPC ..... *H01B 7/0018* (2013.01); *H01F 27/2847* (2013.01)

(58) Field of Classification Search
CPC ..... H01F 27/2847
(Continued)

(56) References Cited

U.S. PATENT DOCUMENTS 5,281,488 A * 1/1994 Poulsen ..... H01B 7/0018 174/117 FF
2005/0103489 A1* 5/2005 Denniel ..... F16L 7/02 166/65.1
(Continued)

FOREIGN PATENT DOCUMENTS

CN 101894620 A 11/2010
DE 17 65 866 A1 10/1971
(Continued)

OTHER PUBLICATIONS

International Search Report of PCT/EP2018/056831 dated Aug. 9, 2018.

*Primary Examiner* — Stanley Tso
(74) *Attorney, Agent, or Firm* — Dickinson Wright PLLC

(57) ABSTRACT

An electrically insulated electrical conductive strip (1), especially for electric motors and transformers, having an electrical conductor (2) in strip form that has an upper face (2*a*) and a lower face (2*b*), two lateral edge faces (2*c*) and one end edge face at each end, and having an electrical insulation (3) disposed on at least one face of the strip (2*a*, 2*b*). The insulation (3) has an enamel layer (3*a*) and an adhesive strip (3*b*) bonded to the lower face (2*b*) and/or the upper face (2*a*) of the electrical conductor (2) in strip form, in each case at least in a region (4) that directly adjoins a lateral edge face (2*c*).

8 Claims, 4 Drawing Sheets

(58) Field of Classification Search
USPC ..... 174/102
See application file for complete search history.

(56) References Cited

U.S. PATENT DOCUMENTS

| | | | | |
|---|---|---|---|---|
| 2008/0246354 | A1* | 10/2008 | Asao | H02K 15/12 310/45 |
| 2015/0243409 | A1* | 8/2015 | Gronowski | H02K 3/40 174/120 SC |
| 2015/0287525 | A1* | 10/2015 | Yamada | H01F 27/24 323/271 |
| 2016/0155540 | A1* | 6/2016 | Matsuda | H01B 11/183 174/107 |
| 2016/0351325 | A1 | 12/2016 | Xie et al. | |

FOREIGN PATENT DOCUMENTS

| | | | |
|---|---|---|---|
| DE | 10 2014 119 720 | A1 | 6/2016 |
| EP | 3 109 873 | A1 | 12/2016 |
| FR | 2 474 397 | A1 | 7/1981 |
| GB | 900519 | * | 7/1962 |
| GB | 900519 | A | 7/1962 |
| GB | 1266367 | A | 3/1972 |

* cited by examiner

ELECTRICALLY INSULATED ELECTRIC CONDUCTOR STRIP, IN PARTICULAR FOR ELECTRIC MOTORS AND TRANSFORMERS

CROSS-REFERENCE TO RELATED APPLICATIONS

This application is a 35 U.S.C. § 371 national phase of PCT International Application No. PCT/EP2018/056831, filed Mar. 19, 2018, which claims the benefit of priority under 35 U.S.C. § 119 to German Patent Application No. 10 2017 107 328.0, filed Apr. 5, 2017, the contents of which are incorporated herein by reference in their entirety.

FIELD OF THE INVENTION

The present invention relates to an electrically insulated electrical conductive strip, especially for electric motors and transformers, having an electrical conductor in strip form that has an upper face and a lower face, two lateral edge faces and one end edge face at each end, and having an electrical insulation disposed on at least one face of the strip.

BACKGROUND

Such electrical conductive strips are referred to, for example, as electrical sheet or electrical strip and are used to establish magnetic circuits for electrical machines, i.e. of cores for dynamos, electric motors, transformers, relays, circuit breakers, inductor coils, ignition coils, electricity meters and controllable deflecting magnets. Customary materials here are especially cold-rolled strips and sheets of iron-silicon alloys. Since eddy currents arise under the influence of variable magnetic fields in a coil core made of solid material, which can cause the core to become hot, the cores are executed exclusively as laminar and insulated sheets in stacks or in the form of wound cut-ribbon cores.

In order to achieve insulation between two mutually superposed conductive strip plies, plastic plies are nowadays used, for example, as insulation in metal strip coils. Polyimide films are often used for this purpose, which are sold, for example, by DuPont under the Kapton® name.

In order to reduce the cost and inconvenience involved in the production of a metal strip coil, an alternative to the laying of films between the strips would be to coat the strip with an electrical insulation enamel on one or both sides, as is known to be implemented with conductors having a round cross section. For this purpose, there are known wire enamels that are synthetic resin-based insulating enamels, which can be applied as very thin, homogeneous, electrically insulating films to copper or aluminium wires. A distinction is made here between different groups of wire enamels, such as THEIC-modified polyesterimides, polyamides and epoxides, solderable wire enamels composed of polyurethane, and adhesive enamels, for example composed of PVB (polyvinylbutyral) and polyimide.

In the enamel coating of an electrical conductive strip of rectangular cross section that can be described as cuboidal in geometric terms and hence has an upper and lower face, two lateral edge faces and one end edge face at each end, however, especially the two lateral edge faces in that case regularly remain insufficiently coated or even completely uncoated. This is because, before the actual polymerization, effected, for example, by what is called a baking operation of the wire enamel, owing to the surface tensions, a meniscus forms, as a result of which the enamel layer then narrows to a minimum or even forms defects during the enamel hardening at the respective upper and lower edge of the lateral edge faces where these each adjoin the faces. The electrical insulating effect is then inadequate here. There can be flashovers between the plies and/or at least formation of stray currents.

It is an object of the present invention to provide an electrically insulated electrical conductive strip of the type specified at the outset, which is producible at reduced cost and inconvenience, especially using a varnish for the insulation, but has a high electrical insulation effect.

SUMMARY

The above object is achieved in accordance with the invention in that the insulation comprises an enamel layer and a film adhesive strip bonded to the lower face and/or the upper face of the electrical conductor in strip form at least, in each case in a region that directly adjoins a lateral edge face.

The strip edge, especially before (or alternatively after) the enamel coating, is laminated with a thermally stable adhesive strip (for example of polyimide). Thus, by comparison with the prior art, it is possible to replace a large area of the costly plastic ply with enamel without impairing the electrical insulation effect at the strip edge.

Further advantageous executions of the invention are described in the detailed description that follows.

DESCRIPTION OF THE DRAWINGS

The invention is elucidated in detail by an example illustrated by the appended drawing.

DETAILED DESCRIPTION OF EMBODIMENTS OF THE INVENTION

Figure 1:
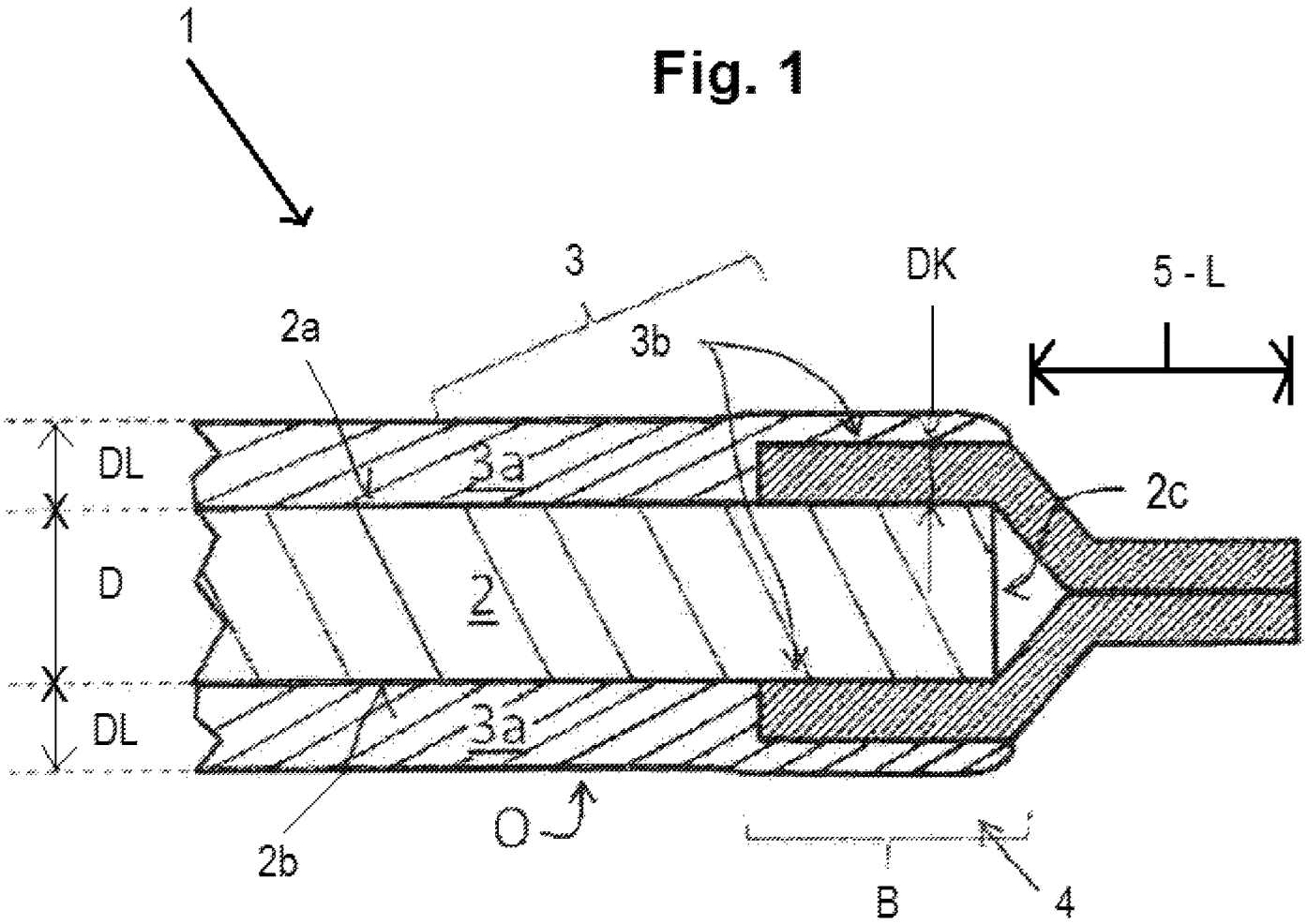
FIG. 1 shows, in a schematic diagram, a conductive strip of the invention.

With regard to the description that follows, it is explicitly emphasized that the invention is not limited to the example, nor is it limited to all or multiple features of combinations of features described. Instead, any individual component feature of the example may be of inventive significance on its own, and also in combination with other component features, even in isolation from all other component features described in connection therewith. FIGS. 2 to 7 identify identical parts of the conductive strip by the same reference numerals.

The inventive conductive strip 1 shown in FIG. 1 comprises an electrical conductor 2 in strip form that has an upper face 2*a* and a lower face 2*b*, two lateral edge faces 2*c* and an end edge face at each end (not shown). In addition, the inventive conductive strip 1 comprises an electrical insulation 3 applied on at least one side of the strip 1; in the embodiment shown, both to the lower face 2*b* and to the upper face 2*a*.

The insulation comprises an enamel layer 3*a* and an adhesive strip 3*b*, especially a film adhesive strip, consisting of plastic and bonded to the lower face 2*b* and/or the upper face 2*a* of the electrical conductor 2 in strip form, in each case at least in a region 4 directly adjoining a lateral edge face 2*c*.

The adhesive strip 3*b* has an excess 5 with respect to the lateral edge face 2*c* of the electrical conductor 1 in strip form, which can prevent stray currents. The excess 5 may preferably have a length L in the range of 0 cm<L≤5 cm.

The electrical conductor 2 in strip form may especially consist of aluminium or of an aluminium alloy and preferably have a thickness D in the range from 0.1 mm to 1.5 mm.

The enamel of the enamel layer 3*a*, which can be applied by dipping, as by electrocoating, or by brush application, roll application, spin-coating, spraying, especially in a continuous belt method, and then cured, has the effect that at least the lower face 2*b* and/or the upper face 2*a* has adequate electrical insulation.

The enamel layer 3*a* may be formed here from an enamel based on organic polymers, as of an acrylic enamel, epoxy enamel, polyester enamel, polyamide enamel or fluoropolymer enamel, or be based on sol-gel compositions, especially of a wire enamel such as a THEIC-modified polyesterimide. It may preferably have a thickness DL in the range from 5 μm to 50 μm. As stated, in the region of the adhesive strip 3*b*, this thickness DL may also be smaller, especially in order to give rise to a flat surface O of the insulation 3.

The adhesive strip 3*b* may preferably have a thickness DK in the range from 3 μm to 20 μm, where this thickness DK may preferably be at least half the thickness DL of the enamel layer 3*a* in the region where there is no adhesive strip 3*b*.

The region 4 directly adjoining the lateral edge face 2*c* of the electrical conductor 2 in strip form may have a width B in the range from 0.2 cm to 4.5 cm, preferably in the range from 0.5 to 1.5 cm.

FIGS. 2 to 7 show further embodiments.

Figure 2:
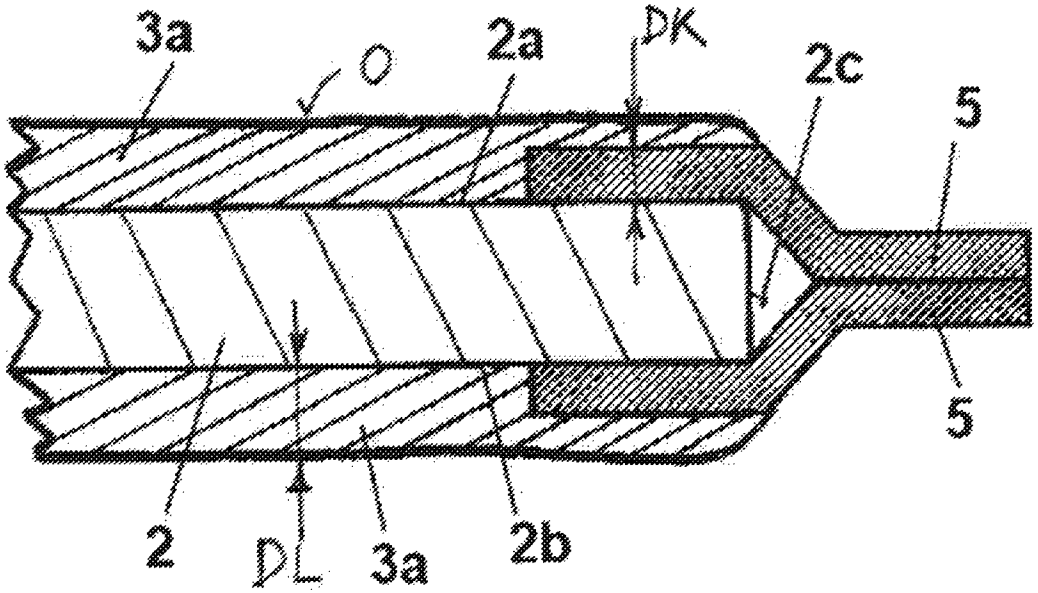

In FIG. 2, the two excesses 5 of the adhesive strips 3*a*, 3*b* applied at either end are bonded to one another by a glue.

Figure 3:
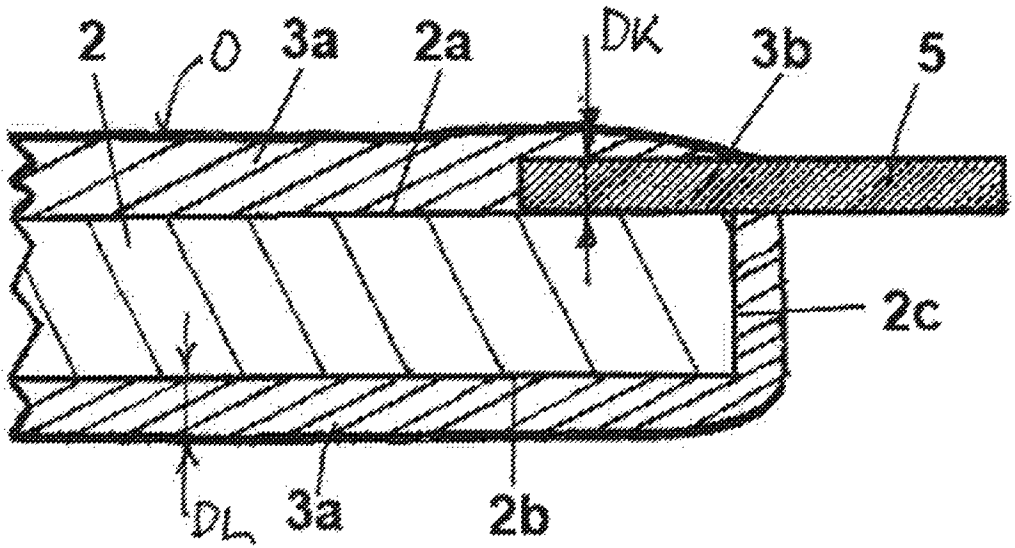
FIGS. 2 to 7 show variants of the conductive strip of the invention.

In FIG. 3, the adhesive strip 3*b* has been applied with the excess 5 only at one end, and the enamel layer 3*a* tapers like a meniscus on the adhesive strip 3*b* and ends before the excess 5. In this case, the lower face 2*b* and the respectively adjoining lateral edge face 2*c* has been provided with the enamel layer 3*a*, where the enamel layer 3*a* at the transition to the lateral edge face 2*c* and thereon may have such a thickness DL that, in itself, is insufficient for the required electrical insulation.

Figure 4:
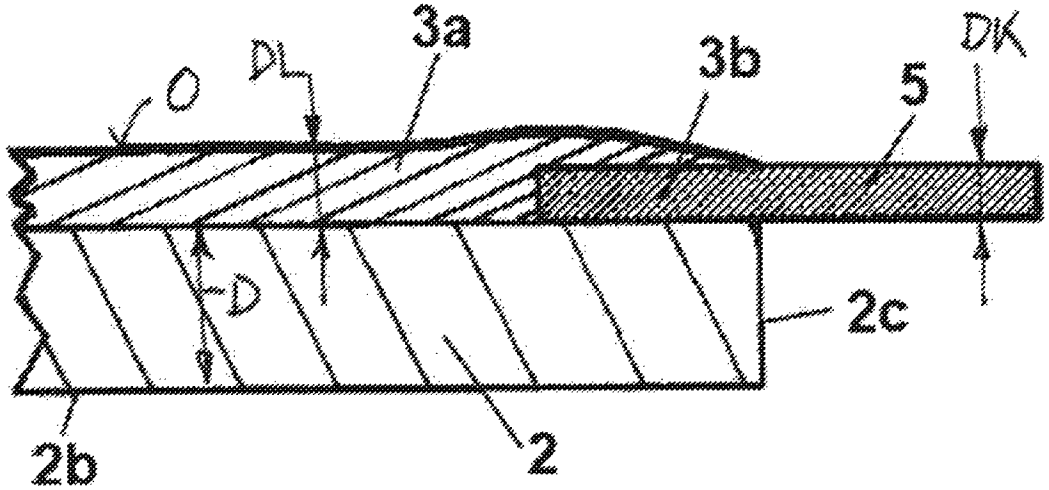

FIG. 4 shows an alternative to FIG. 3, in which the face 2*b* and lateral edge face 2*c* each have no electrical insulation and especially no enamel layer 3*a*.

Figure 5:
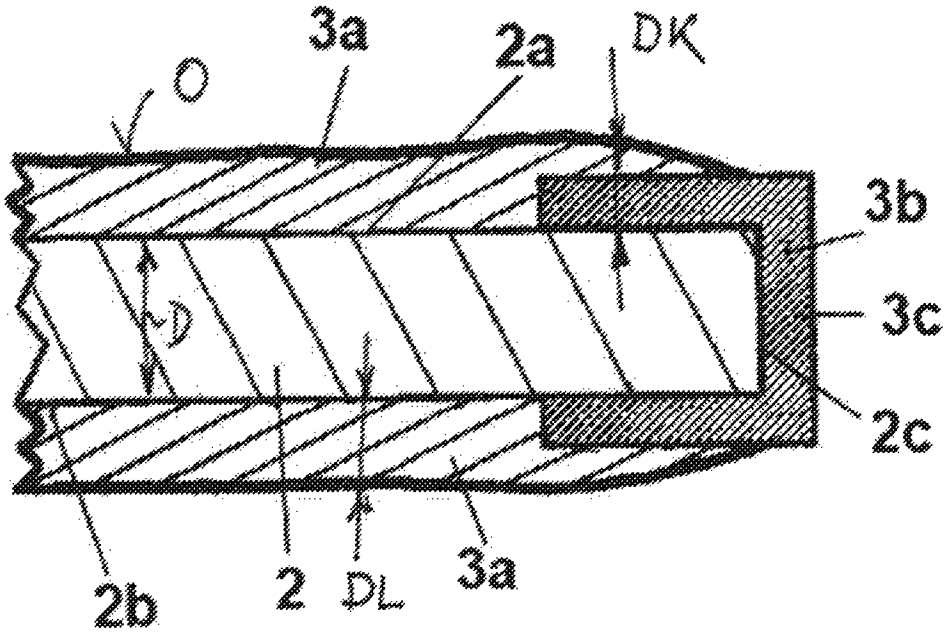

FIG. 5 shows a variant in which the adhesive strip 3*b* is bonded in a C shape around the lateral edge face 2*c* proceeding from the two faces 2*a*, 2*b* by a cover section 3*c*. In this execution too, the enamel layer 3*a* ends like a meniscus on the adhesive strip 3*a* before commencement of the cover section 3*c*.

Figure 6:
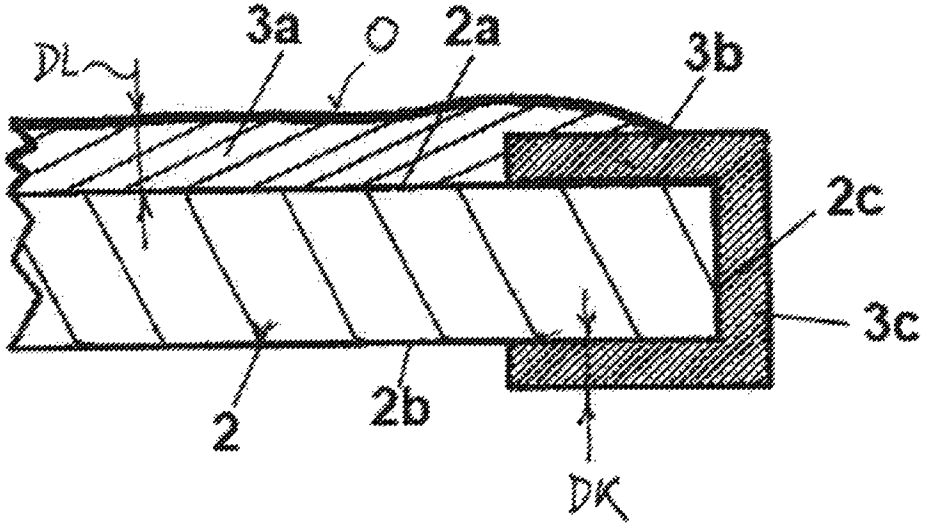

FIG. 6 shows an alternative to FIG. 3. In this case, the enamel layer 3*a* has been applied only on one side of the upper face 2*a* and on the adhesive strip 3*b* up to the start of the cover section 3*c*.

Figure 7:
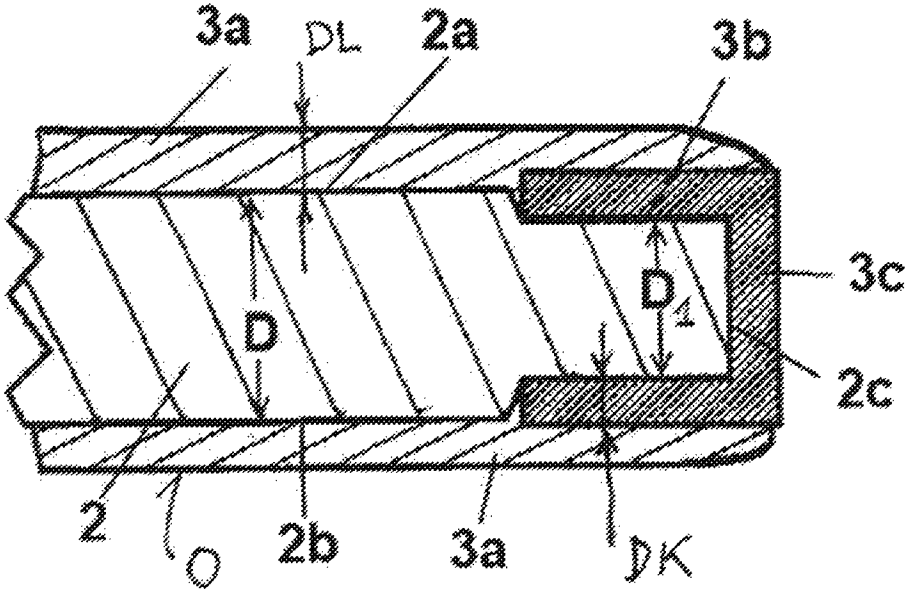

FIG. 7 shows a variant of FIG. 5. Here, the electrical conductor 2, in the region of its lateral edge face 2*c*, has a reduced strip thickness Di compared to the strip thickness D in the rest of the strip region. In this case, in particular, the reduction in strip thickness in the region of the faces 2*a*, 2*b* is the same and is less than/equal to the thickness DK of the adhesive strip 3*b*. The enamel layer 3*a* runs here continuously up to the cover section 3*c*.

The person skilled in the art is also able to add further technical features without leaving the scope of the invention. For instance, the working example shows just one option for the lamination with the adhesive strip 3*b*. Alternatively, it is also possible to lay an adhesive strip 3*b* around the edge area 2*c*, or the enamel layer 3*a* could be beneath the adhesive strip 3*b*.

While the above description constitutes the preferred embodiment of the present invention, it will be appreciated that the invention is susceptible to modification, variation and change without departing from the proper scope and fair meaning of the accompanying claims.

What is claimed is:

1. An electrically insulated electrical conductive strip, adapted for use in machines and devices including electric motors and transformers comprising, an electrical conductor in a strip form that has an upper face and a lower face, two lateral edge faces and one end edge face at each end, and an electrical insulation disposed on at least one of the faces of the strip, wherein the insulation comprises an enamel layer and an adhesive strip bonded to the lower face or the upper face of the electrical conductor in a strip form, at least in a region of the upper or lower face that directly adjoins one of the lateral edge faces, such that the insulation bordering on the region with the adhesive strip is exclusively formed by the enamel layer;

wherein the enamel layer is formed from an enamel based on a THEIC-modified polyesterimide, the enamel layer having a thickness in the range from 5 μm to 50 μm;

wherein the adhesive strip has a thickness in the range from 3 μm to 20 μm, and the thickness is at least half the thickness of the enamel layer in a region where there is no adhesive strip.

2. The conductive strip according to claim 1 further comprising, the adhesive strip is bonded in a C shape around one of the lateral edge faces proceeding from the upper and the lower faces.

3. The conductive strip according to claim 1 further comprising, the adhesive strip has an excess with respect to one of the lateral edge faces of the electrical conductor in strip form having a length less than or equal to 5 cm.

4. The conductive strip according to claim 1 further comprising, the electrical conductor in strip form consists of aluminium or of an aluminium alloy and has a thickness in the range from 0.1 mm to 1.5 mm.

5. The conductive strip according to claim 1 further comprising, the enamel layer is formed above or beneath the adhesive strip.

6. The conductive strip according to 1 further comprising, a region of the adhesive strip directly adjacent to one of the lateral edge faces of the electrical conductor in strip form has a width in the range from 0.2 cm to 4.5 cm.

7. The conductive strip according to claim 1 further comprising, a region of the adhesive strip directly adjacent to one of the lateral edge faces of the electrical conductor in strip form has a width in the range from 0.5 to 1.5 cm.

8. The conductive strip according to claim 1 further comprising, the insulation is disposed on both the upper and the lower face.

* * * * *